US007234841B2

(12) United States Patent
Nash

(10) Patent No.: US 7,234,841 B2
(45) Date of Patent: Jun. 26, 2007

(54) ADJUSTABLE SUPPORT FOR AN ELECTRICAL ASSEMBLY

(75) Inventor: Derek J. Nash, Christiansburg, VA (US)

(73) Assignee: Hubbell Incorporated, Orange, CT (US)

( * ) Notice: Subject to any disclaimer, the term of this patent is extended or adjusted under 35 U.S.C. 154(b) by 350 days.

(21) Appl. No.: 10/755,683

(22) Filed: Jan. 13, 2004

(65) Prior Publication Data

US 2005/0152144 A1 Jul. 14, 2005

(51) Int. Cl.
*F21V 21/28* (2006.01)

(52) U.S. Cl. ..... 362/275; 362/269

(58) Field of Classification Search ..... 362/188, 362/276, 269, 285, 275
See application file for complete search history.

(56) References Cited

U.S. PATENT DOCUMENTS 3,902,931 A 9/1975 Danciger et al.
4,768,020 A * 8/1988 Chen ..... 340/567
5,258,899 A 11/1993 Chen
5,381,323 A * 1/1995 Osteen et al. ..... 362/276
5,649,761 A 7/1997 Sandell et al.
5,867,099 A 2/1999 Keeter
6,091,200 A 7/2000 Lenz
6,213,617 B1 4/2001 Barker
6,409,131 B1 6/2002 Bentley et al.
6,781,129 B2 * 8/2004 Leen ..... 250/342
6,956,493 B1 * 10/2005 Youngblood ..... 340/693.9

* cited by examiner

*Primary Examiner*—Ali Alavi
*Assistant Examiner*—Hargobind S. Sawhney
(74) *Attorney, Agent, or Firm*—Garrett V. Davis; Mark S. Bicks; Alfred N. Goodman

(57) ABSTRACT

An electrical assembly includes an electrical device such as a lighting device, and a support member and a control device such as a motion detector for actuating the electrical device and coupled to the support member. In one embodiment, the control device is connect to a mounting arm that is mounted to the support member in a manner that the mounting arm is rotationally and axially adjustable with respect to the support member so that the control device is rotationally and axially adjustable with respect to the electrical device. In one embodiment, the electrical device is connected to and supported by the support member. The position of the control member can be adjusted to any selected position in a path orbiting a central axis of the electrical device and can be adjusted in an axial direction with respect the axis of the electrical device. The control device is also pivotally connected to the support arm to enable positioning of the control device with respect to the support arm.

34 Claims, 5 Drawing Sheets

ADJUSTABLE SUPPORT FOR AN ELECTRICAL ASSEMBLY

FIELD OF THE INVENTION

The present invention relates generally to an electrical assembly including an electrical device and a control device for actuating the control device. In particular, the invention is directed to a lighting assembly having a control device that is connected to a mounting arm where the position of the control device can be adjusted with respect to the lighting device to provide the optimum operation and functioning of the control device.

BACKGROUND OF THE INVENTION

Electrical assemblies and in particularly lighting assemblies are commonly used in conjunction with motion detectors or light sensing devices to actuate the lighting assembly. These lighting assemblies are commonly used in areas to turn on a light for a predetermined period of time and then turn off the light automatically to reduce energy consumption.

Infrared motion detectors are known and commonly used to turn on a light when a person or motor vehicle enters a selected area. The devices are commonly used for outdoor lighting in residential or commercial areas to illuminate an area as a person or object approaches the designated area. Such devices are commonly used in conjunction with security systems to actuate the light when an unauthorized person enters a designated area. The infrared motion detector functions by sensing heat from the person in the form of infrared radiation as the person enters and moves about in the field of view of the detector. The motion detector detects a selected heat impulse characteristic of the moving person and produces an electrical signal to activate the lighting assembly. Motion detectors typically have a timer to keep the lighting assembly on for a predetermined period of time after the motion has been detected. The lighting assembly is then automatically turned off at the end of the predetermined period of time until motion is again detected by the motion detector.

Lighting devices that include a motion detector commonly include a base that can be mounted to a wall or ceiling. The assembly includes one or more lighting members that are mounted to the base. The lighting assembly often includes a pivoting or swivel coupling to orient the light beam in the desired location. The motion detector is also mounted to the base by a pivoting coupling so that the motion detector can be positioned to orient the field of view in the desired location. Examples of this type of lighting device are disclosed in U.S. Pat. No. 5,649,761 to Sandell et al., U.S. Pat. No. 5,258,899 to Chen and U.S. Pat. No. 6,791,200 to Lenz.

A disadvantage of many of the lighting assemblies that use infrared motion detectors is that the heat generated from the light source can produce a false indicator. This commonly occurs when the lamp or the base supporting the lamp fall within the field of view of the motion detector. Heat generated from the lamp after the lamp has been turned off can give a false indication and reactivate the motion detector. To avoid this problem, some manufacturers have provided a timer that prevents the motion detector from actuating the lamp within a predetermined period of time after the lamp has been turned off. This allows the lamp a period of time to cool down to prevent heat from the lamp activating the motion detector. Depending on the size of the lamp and heat generated, the length of time that the motion detector is deactivated can provide an unacceptable deactivation time period.

Accordingly, there is a continuing need in the industry for improved electrical assemblies having a control device such as motion detectors.

SUMMARY OF THE INVENTION

The present invention is directed to an electrical assembly having an electrical device and a control device for actuating the electrical device. The invention is particularly directed to an electrical assembly where the electrical device is a lighting assembly and where the control device is connected to the lighting assembly to actuate the lighting assembly.

Accordingly, a primary aspect of the invention is to provide an electrical assembly having an electrical device, a support member for the electrical device and a control device adjustably connected to the support member for selectively positioning the control device with respect to the electrical device. The control device is coupled to a support arm which is adjustably connected to the support member.

Another aspect of the invention is to provide an electrical assembly including a lighting device and a control device for the lighting device where the control device can be selectively positioned at any location surrounding the lighting device. In one embodiment, the control device is positioned at any location in a path orbiting an axis of the lighting device. In one preferred embodiment, the position of the control device is adjustable in a substantially circular path around a vertical axis of the lighting device and in an axial direction with respect to the vertical axis.

A further aspect of the invention is to provide an electrical assembly including a lighting device having a central longitudinal axis and a control device operatively connected to the light device. The control device is supported by a member that enables the control device to be selectively positioned in a path concentric with and surrounding the central axis of the lighting device and in an axial direction with respect to the central axis of the lighting assembly.

Still another aspect of the invention is to provide an electrical assembly where the electrical assembly includes a lighting device, a support member, a control member and a support arm for coupling the control member to the support member. In one embodiment, the support member is coupled directly to the lighting device to support the lighting device. The support member can be oriented in a vertical direction so that the lighting device is suspended from the support member. The mounting arm includes a bracket at one end that can be removably coupled to the support member and can be adjusted to any angular and axial position with respect to the support member. Preferably, the bracket of the support arm allows the support arm to be rotated 360° with respect to the support member. The control device is coupled to one end of the mounting arm by a coupling member that allows the control device to be rotated 360° with respect to the axis of the coupling member.

The various aspects of the invention are basically attained by providing an electrical assembly comprising an electrical device, a support member with a longitudinal dimension, a support arm and a control device operatively connected to the electrical device. The support arm has a first end coupled to the support member and a second end coupled to the control device. The position of the control device is adjustable with respect to the electrical device in a substantially circular path around the electrical device.

The aspects of the invention are further obtained by providing a lighting assembly comprising a lighting device, support arm and a control device. The lighting device has a support member coupled to and extending from the lighting device. The support member supports the lighting device in an operating position. The support arm has a first end coupled to the support member and is moveable in a path around an axis of the support member. The control device is coupled to a second end of the support arm and is operatively connected to the lighting device. The position of the control device is adjustable around an axis of the lighting device.

The aspects of the invention are also obtained by providing a lighting assembly comprising a rigid support member having a longitudinal axis, a lighting device coupled to and supported by the support member, a support arm and a control device. The support arm has a first end coupled to the support member and is adjustably positioned on the support member. The control device is operatively connected to the lighting device and coupled to a second end of the support arm. The control device is adjustably position with respect to the lighting device in an axial direction and in an arcuate direction with respect to the lighting device.

These and other aspects of the invention will become apparent from the following detailed description of the invention which in conjunction with the annexed drawings disclosed one embodiment of the invention.

BRIEF DESCRIPTION OF THE DRAWINGS

The following is a brief description of the drawings in which.

DETAILED DESCRIPTION OF THE INVENTION

Figure 1:
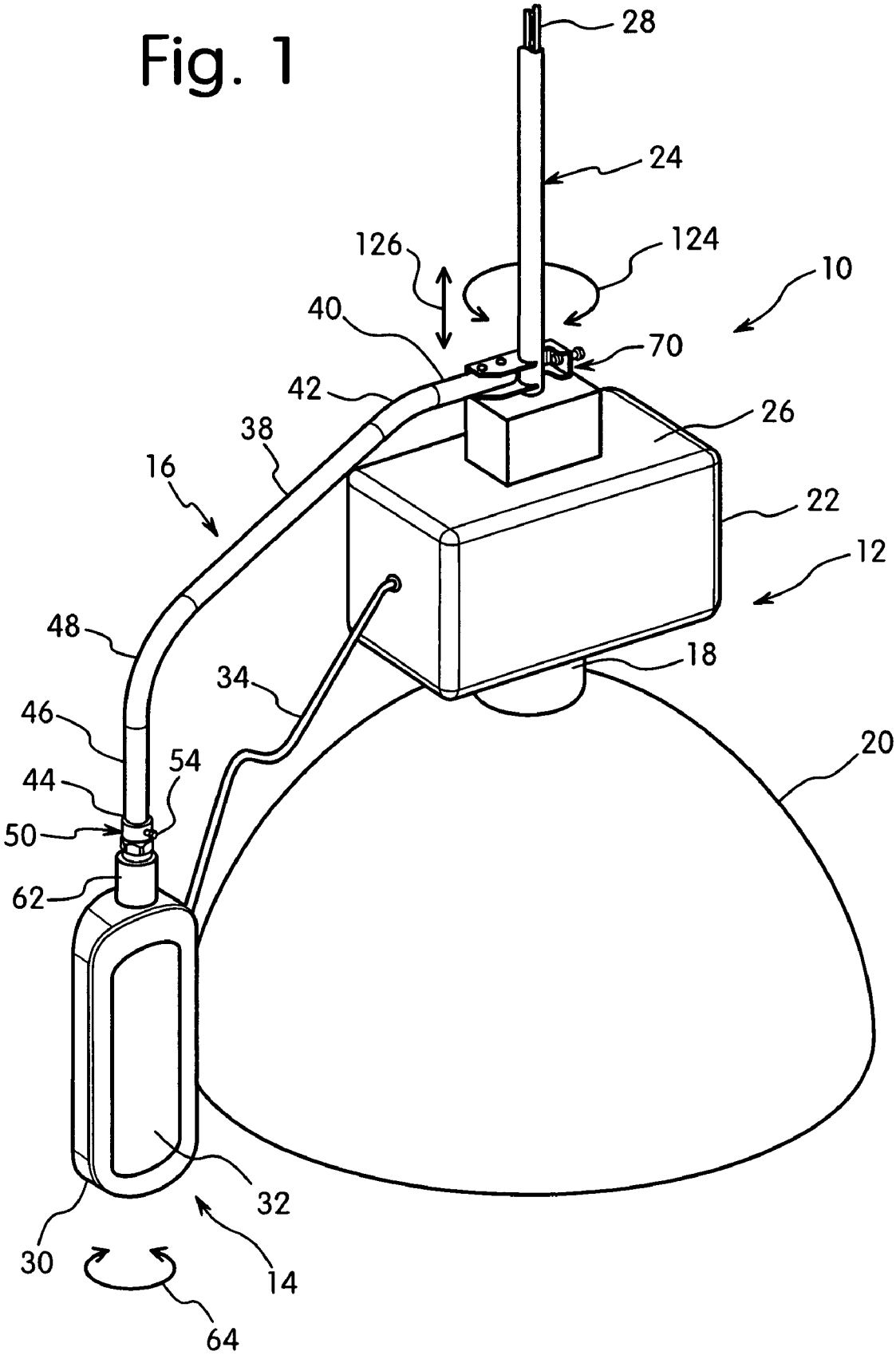
FIG. 1 is a perspective view of the electrical assembly in one embodiment of the invention showing a lighting device, support member, support arm and control device.

Referring to the drawings, the present invention is directed to an electrical assembly 10 including an electrical device which is typically a lighting device 12 connected to a control device 14 where control device 14 is supported by a support arm 16.

Referring to FIG. 1, the electrical device in the illustrated embodiment is lighting device 12 having a lamp holder 18 receiving a lamp or light bulb (not shown) surrounded by a diffuser or shade 20. Lighting device 12 also includes an electrical box 22 for receiving electrical wiring, switches and other electrical components for operating lighting device 12. In the embodiment shown in the drawings and discussed herein, the electrical device is a lighting assembly although other electrical devices can be used in other embodiments of the invention. For example, the electrical device can be a switch or operating device for actuating a number of different electrical components or devices such as a door. Although one preferred embodiment of the invention utilizes a lighting device, it will be understood that the invention is not limited to a lighting device.

Referring to FIG. 1, lighting device 12 is connected to a support member such as a conduit 24. Conduit 24 in the embodiment of FIG. 1 is coupled to a top end 26 of electrical box 22 by standard conduit coupling assembly. In this embodiment, lighting device 12 is coupled to and suspended by conduit 24 where conduit 24 is oriented in a substantially vertical position. In the embodiment shown, the lamp and lamp shade 20 are oriented in a substantially downward direction. In alternative embodiments, the lamp and lamp shade 20 can be oriented in any desired position so that the light can be directed in a selected direction. Conduit 24 can be coupled to a side of electrical box 22 in other embodiments of the invention. In one preferred embodiment, conduit 24 receives and encloses electrical wiring 28 to supply electrical power to electrical box 12 and lighting device 12. The upper end of conduit 24 is connected to a suitable anchor or other support member (not shown) to support lighting device 12. In other embodiments, electrical wiring can be supplied to electrical box 24 by other methods or by a separate conduit that is not intended to support lighting assembly 12.

Control device 14 is operatively connected to lighting device 12 to actuate and control the function and operation of lighting device 12. In one embodiment, control device 14 is a motion detector 30 as known in the art. Alternatively, control device 14 can be a light sensor, dimming device or other device capable of actuating the electrical device. The motion sensor typically includes a sensor that is responsive to infrared radiation and a lens 32 to define a sensing and detection zone and the field of view of motion detector 30. The field of view of the motion detector is generally in the range of about 90–180°. In preferred embodiments of the invention, motion detector 30 preferably has a sensitivity setting to adjust the coverage area and depth of field. Motion detector 30 also preferably includes a delay feature to prevent actuating lighting assembly 12 under false condition. An adjustable timing device is also included to select the length of time that the lighting device 12 remains on after being actuated by motion detector 30. As shown in FIG. 1, motion detector 30 is connected to electrical box 22 by electrical wiring 34 to operate and actuate lighting device 12.

Support arm 16 in the embodiment illustrated has a substantially tubular construction with a main body portion 36, a first end 38 having a first end portion 40 coupled to main body portion 36 by an elbow section 42. Support arm 16 also has a second end 44 with a second end portion 46 coupled to main body portion 36 by a second elbow 48. In the embodiment illustrated, support arm 16 is a rigid structure capable of supporting control device 14 and retaining control device 14 in a fixed selected position. In this embodiment, first elbow 42 and second elbow 48 are rigid members that define fixed angles between main body portion 36 and first end portion 40 and second end portion 46 respectively. In alternative embodiments, first elbow section 42 and second elbow section 48 can include a flexible linkage or a swivel type joint to enable selective adjustment of the angles between the respective components of support arm 16.

In another embodiment of the invention, the support arm can be made as a single unitary unit rather than the sections coupled together as in the illustrated embodiment. For example, the support arm can be made from a single piece that is formed such as by bending or molding to obtain the shape in the illustrated embodiment and having a main section with first and second end sections.

In the embodiments shown, the support arm is formed from substantially straight sections of round tubing connected together by angled coupling joints. In other embodiments, the support arm can be made of any suitable material having sufficient strength to support the control device. The support arm can be of any suitable configuration for positioning the control device with respect to the electrical device. For example, the support arm can be a single piece of tubing that is bent or curved to extend from the support member to orient the control device in the desired position for best operation of the control device. In the illustrated embodiments, the electrical device is a lighting device that is suspended by a conduit that functions as the support member so that the control device is positioned adjacent the lighting device. To position the control device adjacent the lighting device, the support arm has a first section extending substantially radially outward from the conduit and a section extending in a downward direction to support the control device. The shape and dimensions of the support arm can be varied depending on the position and orientation of the support member and the desired location and orientation of the control device. In a further embodiment of the invention, the support arm can have an extendable or telescoping section to provide variable spacing of the control device from the lighting device.

Figure 2:
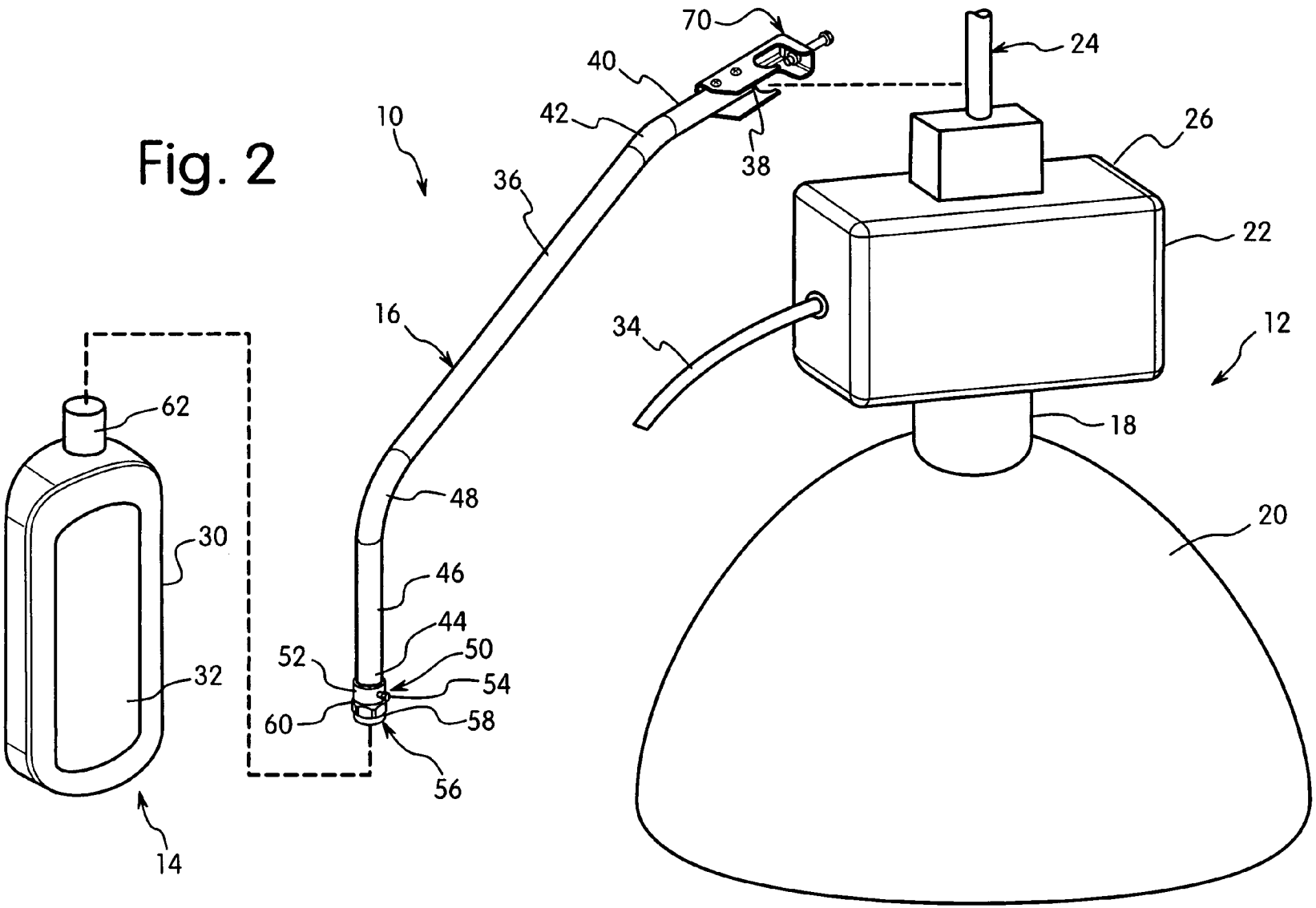
FIG. 2 is an exploded view of the electrical assembly of FIG. 2.
Figure 3:
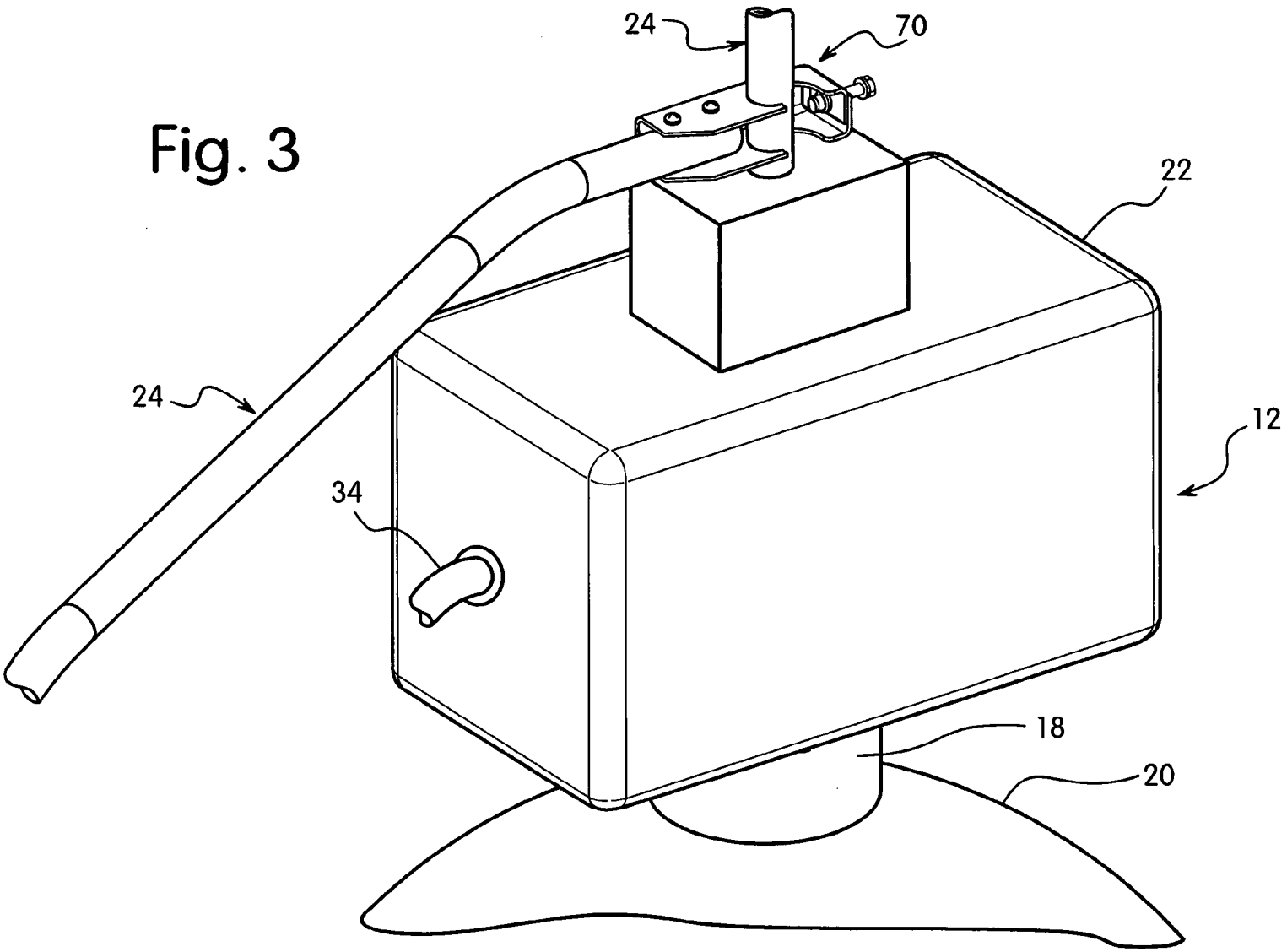
FIG. 3 is an enlarged perspective view showing the support arm and mounting bracket coupled to the support member.

Referring to FIGS. 1 and 2, second end 44 of second end portion 46 includes a connector 50 for connecting control device 14 to second end 44. Connector 50 can be any suitable connector capable of supporting and coupling control device 14 to support arm 16. In the illustrated embodiment, connector 50 includes a sleeve 52 that slides over the end of second end portion 46. Sleeve 52 includes a threaded aperture for receiving a screw 54 which can be tightened to secure second end portion 46 within sleeve 52. Connector 50 also includes a connecting end portion 56 with external threads 58. A locking ring 60 having internal threads is screwed onto threads 58 of connecting end portion 56 as shown in FIG. 2.

Control device 14 in the illustrated embodiment includes a mounting collar 62 having internal threads for mating with threads 58 of connecting end portion 56 of connector 50. Control device 14 is coupled to connector 50 by screwing collar 16 onto treads 58 of connector 50. In this manner control device 14 is pivotally connected to second end 44 of support arm 16 so that control device 14 can be rotated about an axis of second end 44 as indicated by arrow 64 in FIG. 1. Control device 14 can be rotated with respect to support arm 16 to a selected orientation to aim control device 14 in any direction with respect to lighting device 12. Once control device 14 is aimed and oriented in the selected location, locking ring 60 is tightened against the end of collar 62 to fix the position of control device 14 with respect to support arm 16. Preferably, collar 62 and connector 50 have a sufficient number of threads so that control device 14 can be rotated 360° with respect to connector 50. In other embodiments, a suitable pivoting or rotatable connection can be used.

Figure 4:
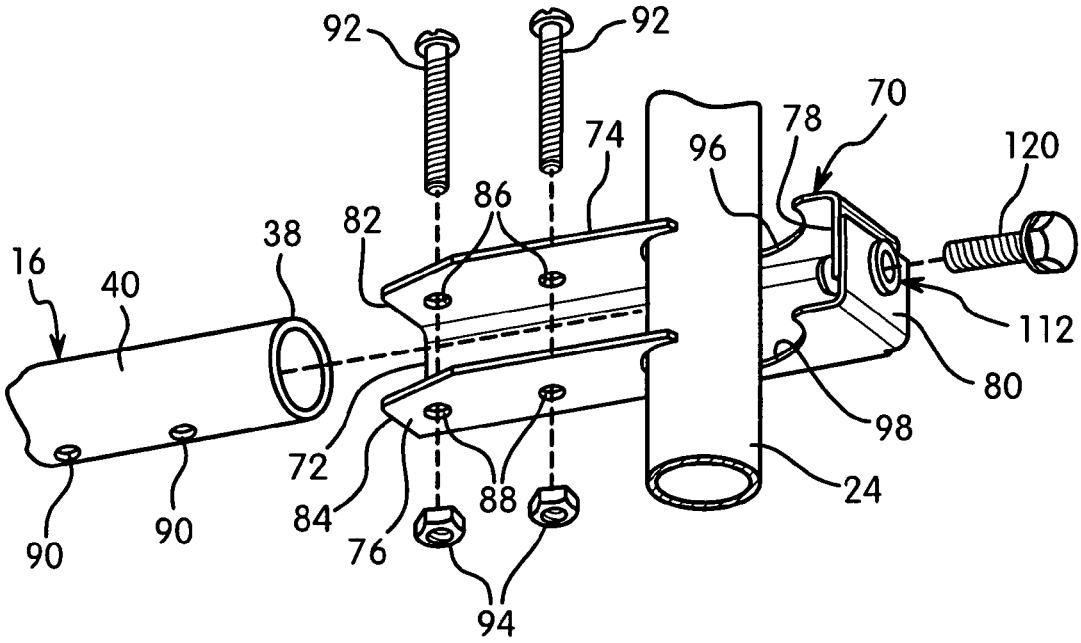
FIG. 4 is an exploded perspective view of the mounting bracket and support arm in one embodiment of the invention.
Figure 5:
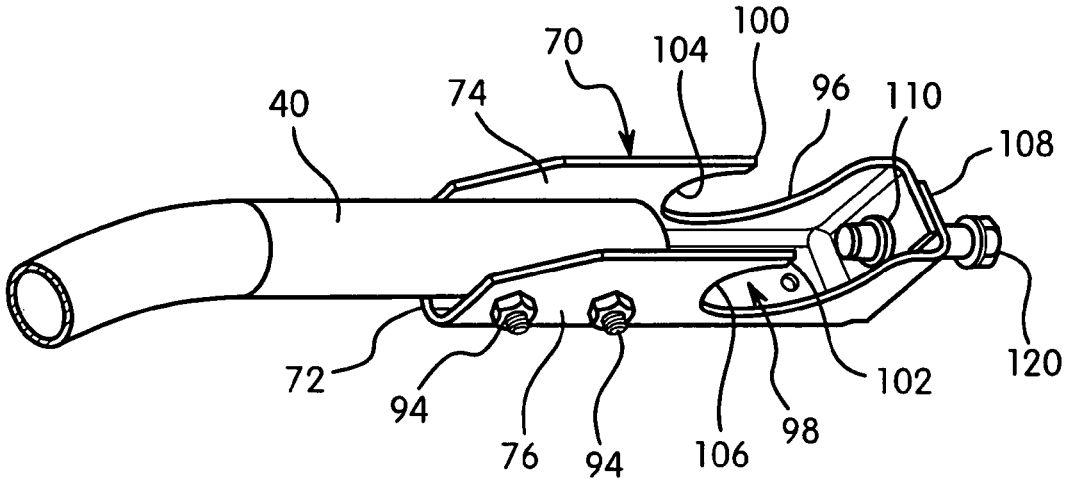
FIG. 5 is a perspective view of the mounting bracket coupled to the support arm.

Support arm 16 is connected to conduit 24 by a coupling member that allows rotational and axial adjustment of the position of support arm 16 with respect to conduit 24. Referring to FIGS. 3–7 the coupling member is a mounting bracket 70 that is coupled to first end portion 40 of support arm 16. In the embodiment shown, mounting bracket 70 has a main body portion 72 with a longitudinal dimension, a top side 74 and a bottom side 76. As shown in FIG. 5, top side 74 and bottom side 76 are substantially parallel to each other and extend from the opposite side edges of body portion 72 in a direction substantially perpendicular to the plane of body portion 72 to define a substantially open U-shape to mounting bracket 70. Mounting bracket 70 includes a closed end wall formed by tabs 78 and 80 extending from top side 74 and bottom side 76, respectively. In the embodiment illustrated, mounting bracket 70 is an integrally formed structure formed from a stamped or pressed sheet metal blank. The portions of the blank forming top side 74, bottom side 76, tab 78 and tab 80 are folded to form mounting bracket 70 as shown. It will be understood that other shapes and materials can be used for mounting bracket 70.

Top side 74 and bottom side 76 have a first end 82 and 84, respectively. Top side 74 includes two apertures 86 adjacent first end 82 and bottom side 76 includes two apertures 88 adjacent end 84 and aligned with apertures 86 of top side 74. First end portion 40 of support arm 16 includes two apertures 90 that are spaced apart a distance corresponding to the spacing of apertures 86. Preferably, the spacing between top side 74 and bottom side 76 corresponds to the outer dimension of first end portion 40 to provide a secure fit of first end portion 40 between top side 74 and bottom side 76. Suitable fasteners, such as screws 92, are inserted through the respective apertures of top side 74 first end portion 40 and bottom side 76 and secured by nuts 94 to couple mounting bracket 70 to first end portion 40. In other embodiments, support arm 16 is attached to mounting bracket 70 by clamping, welding or other fastening methods.

Top side 74 and bottom side 76 of mounting bracket 70 each have an open recessed portion 76 forming an axial passage 98. Top side 74 and bottom side 76 each include a leg 100 and 102 respectively to define substantially U-shaped sections 104 and 106 of recessed portion 96, respectively. U-shaped sections 104 and 106 preferably have an internal dimension complementing the outer dimension of conduit 24 so that conduit 24 can seat securely within U-shaped sections 104 and 106 as shown in FIG. 4. The open sides of recessed portion 96 preferably have a dimension to enable mounting bracket 70 to slide over conduit 24 so that conduit 24 can seat within U-shaped sections 104 and 106.

First end 82 of top side 74 and first end 84 of bottom side 76 overlay each other to form an end wall 108 of mounting bracket 70. First ends 82 and 84 include aligned apertures to define an opening 110 in wall 108. A coupling member 112 is inserted through opening 110 and secured to end wall 108 by a suitable method such as riveting, crimping, welding and the like. Coupling member 112 includes an annular sleeve 114 having internal threads 116 and a collar 118. Collar 118 extends radially outward from one end of sleeve 114 and is seated against the outer surface of end wall 108 as shown in FIG. 4. Coupling member 112 receives a fastener for securing mounting bracket 70 to conduit 24. In the embodiment shown, the fastener is a screw 120 having external threads 122 that mate with threads 116 of sleeve 114. Screw 120 has an axial length sufficient enough to pass through sleeve 114 and contact conduit 24.

Figure 6:
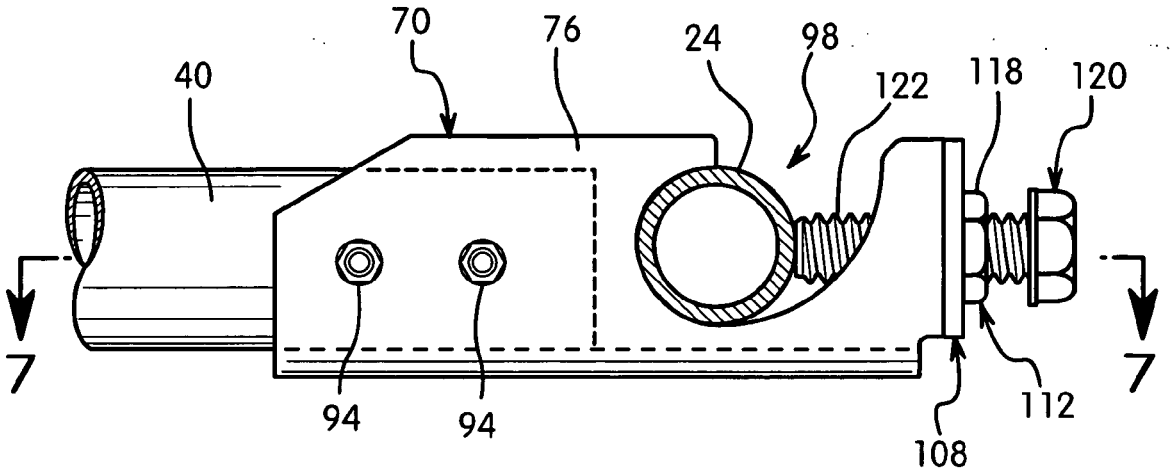
FIG. 6 is a bottom view of the mounting bracket and support arm coupled to the support member.
Figure 7:
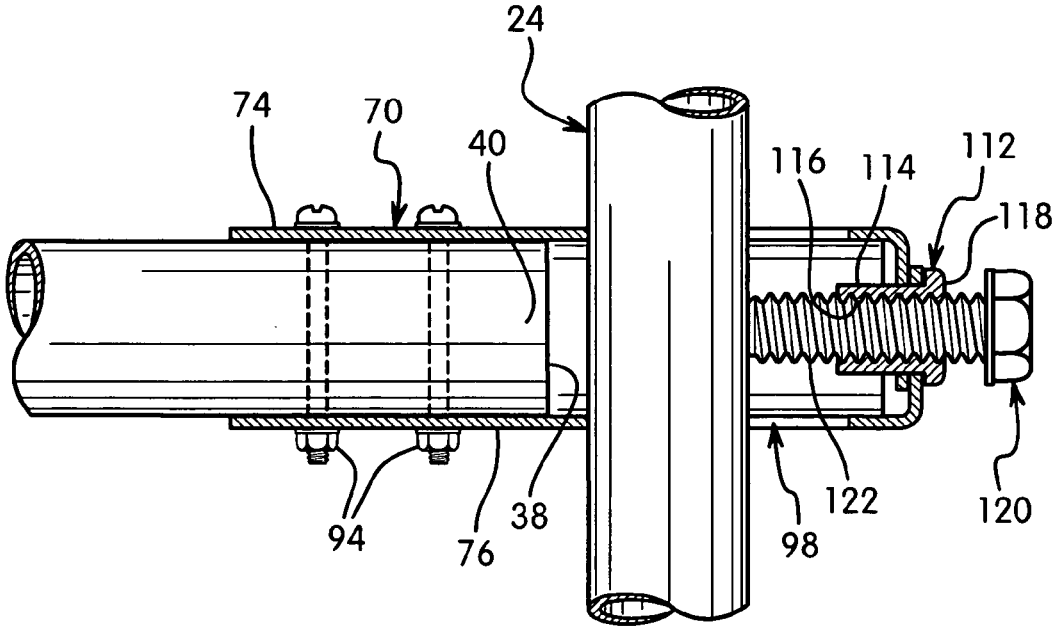
FIG. 7 is a cross sectional side view of the mounting bracket and support arm taken along line 7—7 of FIG. 6 and showing the mounting bracket coupled to the support member.

Support arm 16 is coupled to conduit 24 by sliding mounting bracket 70 over conduit 24 and positioning conduit 24 in U-shaped section 104 of recessed portion of 96 of mounting bracket 70. In this embodiment, support arm 16 and mounting bracket 70 can be rotated around conduit 24 to any selected position around conduit 24 as indicated by arrow 124 in FIGS. 1 and 3. Mounting bracket 70 is also adjustable along the axial length of conduit 24 so that support arm 16 can be selectively positioned at any position along the axial length of conduit 24 as indicated by arrow 126. Once the desired position of support arm 16 is obtained, screw 120 is threaded into coupling member 112 and tightened against conduit 24 to couple mounting bracket 70 to conduit 24 as shown in FIGS. 6 and 7. In this embodiment, first end portion 40 of support arm 16 and mounting bracket extend in a substantially radial outward direction from conduit 24 and second end portion 46 of support arm 16 extends in a direction substantially parallel to the axis of conduit 24.

In the embodiment illustrated, control device 14 is a motion detector 30 coupled to the second end 44 of support arm 16. Motion detectors typically have a limited field of view so that it is necessary to orient motion detector 30 in the proper position to ensure the proper function and operation of lighting device 12. Support arm 16 is coupled to conduit 24 by mounting bracket 70 so that motion detector 30 and support arm 16 can be positioned at a selected angular position with respect to conduit 24 by rotating bracket 70 and support arm 16 around the axis of conduit 24. In addition, mounting bracket 70 is slidable on conduit 24 so that the motion detector 30 can be adjusted axially with respect to conduit 24 to raise and lower motion detector 30 with respect to lighting device 12. In this manner, the motion detector 30 can be positioned in any location in a path orbiting the center axis of conduit 24 and the center axis of lighting device 12. In addition, the axial spacing between lighting device 12 and the motion detector 30 can be adjusted by sliding mounting bracket 70 along the axial length of conduit 24.

In the illustrated embodiment, conduit 24 defines a support member for lighting assembly 12 and for supplying electrical wiring to lighting device 12. In alternative embodiments of the invention, an electrical device is connected to a support member and electrical wiring is supplied to the electrical device by separate means. Preferably, the support member has a cylindrical outer surface capable of mating with mounting bracket 70 to allow rotational and axial adjustment of mounting bracket 70 with respect to the support member.

In the embodiment shown in FIGS. 1–7, the electrical assembly is a lighting device and an infrared motion detector. In this embodiment, the support arm positions the motion detector radially outward from the lighting device and allows some axial or height adjustment of the motion detector with respect to the lighting device. The support arm is able to pivot completely around the conduit so that the motion detector can be positioned at any selected location in the circle that is substantially concentric with the center axis of the lighting device. The motion detector is then rotated with respect to the support arm to direct the field of view of the motion detector in the desired area. In one preferred embodiment, the support arm is fixed to the mounting bracket so that the support arm cannot be moved after the mounting bracket is secured to the support member. In other embodiments, the angular position of the support arm with respect to the mounting bracket can be adjusted which can adjust the angle of the motion detector with respect to the mounting bracket. In this manner, the field of view of the motion detector can be angled up or down as needed by rotating the support arm with respect to the mounting bracket.

As shown in the Figures, the support member is a conduit that is aligned with the axial center of lighting device 12 or other electrical device so that lighting device 12 is suspended by the conduit with the conduit oriented in a substantially vertical position. In alternative embodiments, the conduit or other support member can be connected to the electrical device in any convenient location and the support member can be oriented in a horizontal or vertical position depending on the particular use of the assembly.

While one embodiment of the invention has been chosen to illustrate the invention, it will be understood by those skilled in the art that various changes and modifications can be made without departing from the spirit and scope of the invention as defined in the appended claims.

What is claimed is:

1. An electrical assembly comprising:

an electrical device having an axis;

a support member with a longitudinal dimension supporting said electrical device;

a support arm having a first end with a coupling member removably and rotatably coupled to said support member, and said support arm having a second end extending in a direction substantially parallel to a longitudinal axis of the support member; and a control device operatively connected to said electrical device and coupled to said second end of said support arm, the position of said control device being adjustable with respect to said electrical device in a path around and encircling said axis of said electrical device.

2. The assembly of claim 1, wherein said electrical device is a lighting device and where said control device actuates said lighting device.

3. The assembly of claim 1, wherein said control device is a motion detector to actuate said electrical device.

4. The assembly of claim 1, wherein said electrical device is coupled to said support member and where said support arm is pivotally coupled to and slidable on said support member so that said control device can be selectively positioned in a substantially circular path around and along a length of said support member.

5. The assembly of claim 1, wherein said support member is a conduit.

6. The assembly of claim 5, wherein said coupling member extends substantially radially outward with respect to said conduit and where said second end of said support arm extends in a direction substantially parallel to a longitudinal axis of said conduit.

7. The assembly of claim 6, wherein said electrical device has an upper end and a side portion, and where said conduit is coupled to said upper end, and said second end of said support arm and said control device are positioned adjacent said side portion of said electrical device.

8. The assembly of claim 1, wherein said control device is rotatably coupled to said second end of said support arm.

9. The assembly of claim 8, wherein said second end of said support arm has a substantially vertical axis and where said control device is pivotable about said vertical axis.

10. The assembly of claim 1, wherein said support member is a conduit for supplying electrical wiring to said electrical device, said first end of said coupling arm having a coupling member with an open side portion for receiving said conduit and a fastener for securing said conduit in said coupling member.

11. The assembly of claim 10, wherein said coupling member has a substantially U-shaped recessed portion for receiving said conduit and where said fastener secures said conduit in said recessed portion.

12. The assembly of claim 1, wherein said support member is vertically oriented and where said support arm has a first portion at said first end extending radially outward from said support member and a second portion at said second end extending substantially parallel to said support member.

13. The assembly of claim 12, wherein said control device is a motion detector and is pivotally coupled to said second end of said support arm so that said motion detector can be aimed in a selected location.

14. A lighting assembly comprising:

a lighting device having a support member coupled to and extending from said lighting device, said support member supporting said lighting device in an operating position;

a support arm having a first end coupled to said support member and being movable in a path around an axis of said support member and being adjustable along an axial length of said support member, said support arm having a second end movable in a path around said axis of said support member and around said lighting device; and a control device, operatively connected to said lighting device and coupled to said second end of said support arm, said control device being adjustably positioned in a path around an axis of said lighting device and around a central axis of said support member.

15. The assembly of claim 14, wherein said support member is a conduit supplying electrical wiring to said lighting device.

16. The assembly of claim 14, wherein said support member is oriented in a substantially vertical position.

17. The assembly of claim 14, wherein said support arm includes a first portion at said first end and extending in a substantially outward direction with respect to said support member and a second portion at said second end and extending in a direction substantially parallel to said support member.

18. The assembly of claim 14, wherein said support member is a cylindrical conduit and said first end of said support arm includes a coupling member removably coupled to said conduit.

19. The assembly of claim 18, wherein said coupling member includes an open side portion for receiving said conduit and a fastener for securing said coupling member to said conduit.

20. The assembly of claim 19, wherein said coupling member includes a substantially U-shaped recessed portion open to said open side portion for receiving said conduit and where said fastener secures said conduit in said U-shaped recessed portion.

21. An electrical lighting assembly comprising:

a rigid support member having a longitudinal center axis;

a lighting device coupled to and supported by said support member;

a support arm having a first end coupled to said support member and being adjustably positioned on said support member, said support arm having a second end; and a control device operatively connected to said lighting device and coupled to said second end of said support arm, said control device being adjustably positioned with respect to said lighting device in an circular path around said longitudinal center axis of said support member and around said lighting device.

22. The assembly of claim 21, wherein said lighting device has a substantially vertical axis and said control device can be adjustably positioned around said vertical axis.

23. The assembly of claim 22, wherein said support member is oriented along a substantially vertical axis and where said support arm is adjustable along said vertical axis of said support member, and where said control device is adjustably positioned in an orbital path around said support member and around said lighting device.

24. The assembly of claim 21, wherein a position of said control device is adjustable along a length of said vertical axis with respect to said lighting device.

25. The assembly of claim 21, wherein said support arm is adjustably positioned along said longitudinal axis of said support member and where said first end of said support arm is rotatably coupled to said support member.

26. The assembly of claim 21, wherein said support member is a conduit and where said lighting device is suspended by said conduit.

27. The assembly of claim 26, wherein said conduit is oriented in a substantially vertical direction, said support arm including a coupling member at said first end and where said coupling member is removably coupled to said conduit so that said control member is selectively positioned in a vertical direction and in a path encircling said lighting device.

28. The assembly of claim 27, wherein said coupling member includes a passage having a dimension for receiving said conduit and a fastener for clamping said coupling member to said conduit.

29. The assembly of claim 28, wherein said control device is a motion sensor operatively connected to said lighting device.

30. An electrical device comprising:

a support member having a longitudinal dimension and a longitudinal axis with a first end and second end;

an electrical device coupled to said second end of said support member;

a support arm having a first end coupled to said support member and having a second end, said first end of said support arm being adjustable axially along the longitudinal dimension of said support member;

a control device operatively connected to said electrical device and coupled to said second end of said support arm, the control device being adjustable with respect to said electrical device and said support member in an axial direction along said support member.

31. The electrical assembly of claim 30, wherein said support arm is rotatable around said support member and electrical device to position said control device in a path surrounding said electrical device.

32. The electrical assembly of claim 30, wherein said first end of said support arm includes a mounting bracket for coupling to said support member, and where said mounting bracket is rotatable around said longitudinal axis of said support member.

33. The electrical assembly of claim 32, wherein said mounting bracket is adjustable axially along the longitudinal dimension of the support member.

34. The electrical assembly of claim 30, wherein said control device is adjustable with respect to said electrical device in a circular path with respect to said longitudinal axis of said support member.

* * * * *